United States Patent [19]

Ishii et al.

[11] Patent Number: 4,663,957

[45] Date of Patent: May 12, 1987

[54] ROLL STAND FOR A COLD FORMING APPARATUS

[75] Inventors: Masami Ishii, Toyota; Hitoshi Sugimoto, Nagoya; Mitsuhiro Ozawa, Hekinan; Yoshitomi Onoda, Kohfu, all of Japan

[73] Assignee: Aisin Seiki Kabushiki Kaisha, Kariya, Japan

[21] Appl. No.: 785,596

[22] Filed: Oct. 8, 1985

[30] Foreign Application Priority Data

Oct. 8, 1984 [JP] Japan ..... 59-212269

[51] Int. Cl.[4] ..... B21D 5/08; B21B 13/00; B21B 31/16

[52] U.S. Cl. ..... 72/179; 72/176; 72/235; 72/237; 72/181

[58] Field of Search ..... 72/176–182, 72/164, 247, 482, 389, 235, 237, 162

[56] References Cited

U.S. PATENT DOCUMENTS

| | | | |
|---|---|---|---|
| 943,902 | 12/1909 | Steele et al. | 72/181 |
| 1,366,331 | 1/1921 | Palmer et al. | 72/237 |
| 1,490,772 | 4/1924 | Gunn | 72/181 |
| 2,011,686 | 8/1935 | Mikaelson et al. | 72/247 |
| 2,183,388 | 12/1939 | Biggert, Jr. . | |
| 2,254,289 | 9/1941 | Jensen | 72/176 |
| 2,279,038 | 4/1942 | Gifford . | |
| 2,288,119 | 6/1942 | Weightman | 72/181 |
| 2,458,906 | 1/1949 | Himmel et al. | 72/178 |
| 2,517,309 | 8/1950 | Heller | 72/164 |
| 2,639,758 | 5/1953 | Heller | 72/164 |
| 2,693,219 | 11/1954 | Heller | 72/164 |
| 2,821,727 | 2/1958 | Corckran | 72/235 |
| 3,368,381 | 2/1968 | Frohling et al. . | |
| 3,427,839 | 2/1969 | Neumann . | |
| 3,456,472 | 7/1969 | Balfanz, Jr. | 72/181 |
| 3,462,989 | 8/1969 | Fischer, Jr. | 72/181 |
| 3,855,834 | 12/1974 | Evans | 72/179 |

*Primary Examiner*—Daniel C. Crane

*Attorney, Agent, or Firm*—Oblon, Fisher, Spivak, McClelland & Maier

[57] ABSTRACT

A roll stand used for a cold forming apparatus wherein a body of the roll stand has a slant surface on which a pair of non-driving rolls are installed so as to press sheet metal therebetween. The angle between the slant surface of the body and a base on which the body is installed is adjustable by rotating the body, thereby twisting the sheet metal.

4 Claims, 5 Drawing Figures

ROLL STAND FOR A COLD FORMING APPARATUS

BACKGROUND OF THE INVENTION

1. Field of the Invention

The present invention relates to a roll stand having a pair of opposed rollers and which is incorporated into a cold forming apparatus for producing a metal plate product such as moldings for motor vehicles, sashes and tubes.

2. Discussion of the Background

In an apparatus for forming a sheet metal into a channel form or configuration disclosed in U.S. patent application Ser. No. 681,187, opposite sides of the sheet metal are gradually bent by a plurality of roll stands while the sheet metal is being fed into the cold forming apparatus.

Since the sheet metal is prepared as a coil unit before forming of the sheet metal into channel form, new sheet metal is fed between the rollers of the roll stand after completion of the formation of the prior sheet metal. However, the properties of the sheet metal such as the modulus of elasticity varies with coil unit of the sheet metal. Thus, the resulting configuration after formation of the sheet metal sometimes differs from the desired configuration.

Such difference in the configuration of the sheet metal is decreased or deleted by increasing the pressure applied to the sheet metal at each roll stand or by relocation of the roll stands with the result being that considerably cumbersome operations are needed.

SUMMARY OF THE INVENTION

Therefore, the object of the invention is to provide a roll stand by which the differences in configuration of the sheet metal is decreased or deleted in spite of the supply of new sheet metal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
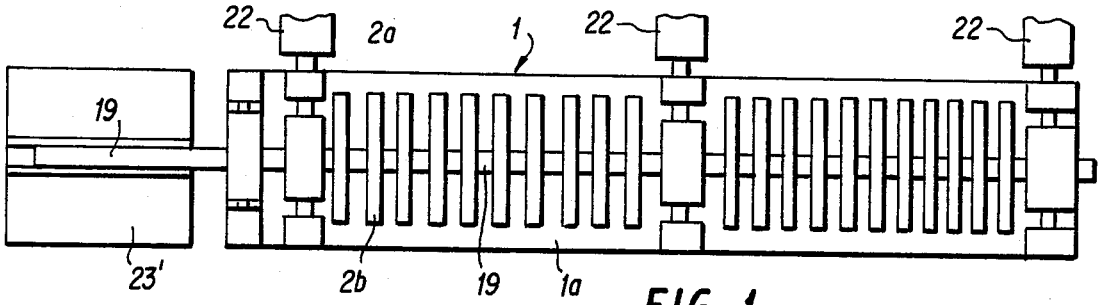
FIG. 1 is a plan view of a cold forming apparatus illustrating a roll stand according to the present invention.
Figure 5:
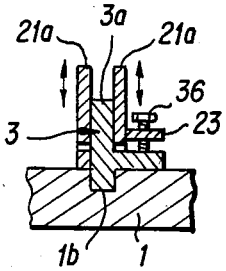
FIG. 5 is a cross-sectional view taken along line V—V in FIG. 2.
Figure 2:
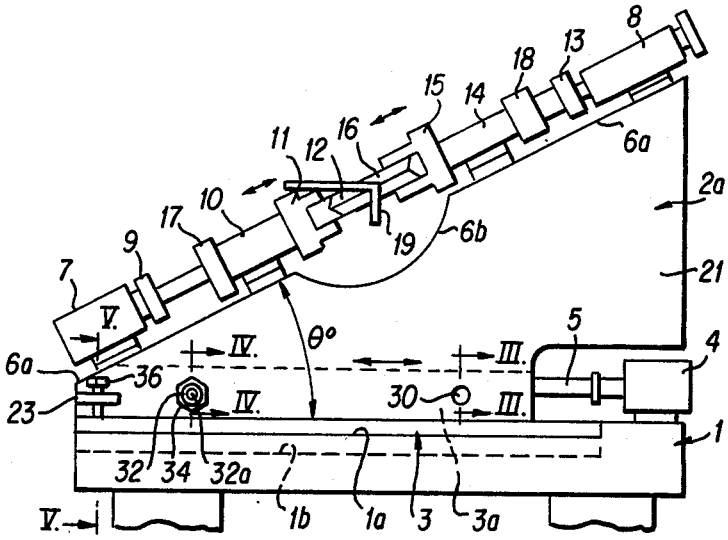
FIG. 2 is a side view of the roll stand of the present invention.
Figure 3:
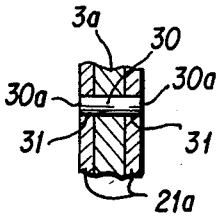
FIG. 3 is a cross-sectional view taken along line III—III in FIG. 2.
Figure 4:
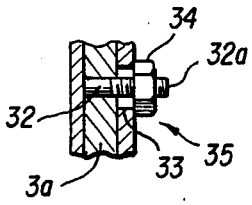
FIG. 4 is a cross-sectional view taken along line IV—IV in FIG. 2.

Referring now to FIGS. 1 through 5, a plurality of roll stands 2*a* and 2*b* are arranged or installed alternately between drive-roll stands 22 having a well-known construction. The roll stand 2*a* is connected with a rail 3 which is movable along a groove 1*b* of base 1 of a cold forming apparatus, the base having an upper surface 1*a*. The roll stand 2*a* is in engagement at right side of lower portion thereof with a screw 5 which is driven by a stepping motor 4. Thus, the roll stand 2*a* may be moved from left to right across the flow line or feeding line of a material or sheet metal 19 in FIG. 2.

The material or sheet metal 19 in the form of a coil unit is fed from a uncoiler 23'. Opposite sides of the sheet metal 19 are gradually bent by roll stands 2*a* and 2*b* so as to form the sheet metal into a channeled configuration.

A body 21 of the roll stand 2*a* has a slant surface 6*a* with a cavity 6*b* for preventing interference of the slant surface 6*a* with the sheet metal 19. A stepping motor 7 is installed on the lower end portion of the slant surface 6*a*. The stepping motor 7 turns a drive shaft 10 through a joint 9 to move a roll holder 11 and a lower non-driving small roller 12 along the slant surface 6*a*. A lock device 17 is provided for locking the drive shaft 10.

A hydraulic cylinder 8 is installed on the upper portion of the slant surface 6*a*. The hydraulic cylinder 8 is connected to a drive shaft 14 through a joint 13 to enable a roll holder 15 and an upper non-driving small roll 16 along the slant surface 6*a*. A lock device 18 is provided for locking the drive shaft 14.

An angle $\theta$ formed between the slant surface 6*a* and an upper surface 1*a* of the base 1 may be varied by rotating the body 21 about a first pin 30. More particularly, the first pin 30 is fixedly driven into a right side portion of an upper projection 3*a* of the rail 3. Opposite end portions 30*a*, 30*a* are respectively passed through a pair of co-axially opposed holes 31, 31 each of which is provided in respective side walls 21*a* of the body 21.

A second pin 32 is fixedly positioned in a left side portion of the upper projection 3*a* of the rail 3. One end portion 32*a* of the pin 32 is passed through a hole 33 of the wall 21*a* of the body 21. The radius of the hole 33 is larger than that of the pin 32. On the end portion 32*a* of the pin 32 is threadly mounted a tightening nut 34 so as to rigidly secure the rail 3 to the body 21. Upon release or loosening of the nut 34, the body 21 may be slightly rotated about the pin 30. The pin 32 and the nut 34 constitute a securing means 35.

A bolt 36 is threadly passed through an outer perpendicular portion 23 of the wall 21*a* and abuts rail 3. By rotating the bolt 36, the aforementioned rotation of the body 21 is performed. Thus, the bolt 36 under such condition constitutes an adjusting means.

The above-mentioned apparatus is operated by a control device (not shown), as follows:

(a) positioning the bending portion of the sheet metal 19 with respect to its pass line by starting the stepping motor 7 for moving the small roll 12 along the slant surface 6*a;*

(b) making the lock device 17 hold the drive shaft 10 of the lower roll 12, and then stopping operation of the stepping motor 7;

(c) operating the hydraulic cylinder 8 to move the upper non-driving small roll 16 and applying pressure to the sheet metal 19;

(d) making the lock device 18 lock the drive shaft 14, and then set the hydraulic cylinder 8 to an OFF condition, and make the upper small roll 16 and the lower small roll 12 contact one another securely; and (e) enabling the roll stand 2*a* (2*b*) to perform the cold forming of the moldings.

If the resulting configuration of the sheet metal 19 differs from desired one, adjustment may be performed by slightly varying angle $\theta$ by rotating the bolt 36 after the nut 32 has been loosen.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A roll stand for a cold forming apparatus, comprising:

a base member having a groove formed therein;

a body member mounted on said base and having a slant surface;

a rail member connected to a lower end portion of said body and slidably fitted in said groove in said base whereby said body member is horizontally movable, said slant surface being obliquely angled relative to said horizontal movement;

first and second opposed non-driving rolls for pressing said sheet metal therebetween wherein said first and second rolls are arranged on said slant surface of said body;

means mounted on said base member for setting said first roll at a first predetermined position taken along said slant surface;

means mounted on said base member for setting said second roll at a second predetermined position taken along said slant surface;

means for rotating said body and for adjusting an angle between said slant surface of said body and said base; and a first pin interconnecting said rail member and said body so as to rotate said body around said first pin, and wherein said body includes a wall having an outer peripheral portion, and an adjusting bolt member spaced from said first pin threadedly passing through said outer peripheral portion and abutting said rail member and which includes means for adjusting and maintaining said angle in response to the stroke of said bolt member.

2. A roll stand as set forth in claim 1, further comprising a second pin mounted on said rail for locking said body to said rail member so as to lock said angle.

3. A roll stand as set forth in claim 2, wherein said second pin is positioned closer to said adjusting bolt member than said first pin.

4. A roll stand as set forth in claim 3, further comprising a tightening member mounted on said second pin for securing said body to said rail member.

* * * * *